US009887057B2

(12) United States Patent
Lam et al.

(10) Patent No.: US 9,887,057 B2
(45) Date of Patent: Feb. 6, 2018

(54) REMOTE ACTIVATED FUSE AND CIRCUIT

(71) Applicant: LITTELFUSE, INC., Chicago, IL (US)

(72) Inventors: Johnny Lam, San Mateo, CA (US); Martyn A. Matthiesen, Fremont, CA (US); Matthew P. Galla, Holly Springs, NC (US); Jianhua Chen, Sunnyvale, CA (US)

(73) Assignee: Littelfuse, Inc., Chicago, IL (US)

( * ) Notice: Subject to any disclaimer, the term of this patent is extended or adjusted under 35 U.S.C. 154(b) by 1003 days.

(21) Appl. No.: 13/682,270

(22) Filed: Nov. 20, 2012

(65) Prior Publication Data

US 2014/0139314 A1 May 22, 2014

(51) Int. Cl.

| | |
|---|---|
| ***H01H 37/02*** | (2006.01) |
| ***H01H 85/46*** | (2006.01) |
| *H01H 37/76* | (2006.01) |
| *H01H 85/02* | (2006.01) |

(52) U.S. Cl.

CPC ..... *H01H 85/463* (2013.01); *H01H 37/76* (2013.01); *H01H 37/761* (2013.01); *H01H 2085/0275* (2013.01); *H01H 2085/466* (2013.01)

(58) Field of Classification Search

CPC .... H01H 85/463; H01H 37/76; H01H 37/761; H01H 2085/0276; H01H 2085/466; H01H 2085/0275

USPC ..... 337/159, 401

See application file for complete search history.

(56) References Cited

U.S. PATENT DOCUMENTS

| | | | | |
|---|---|---|---|---|
| 3,575,681 | A * | 4/1971 | Nusbaum | H01H 85/0241 257/665 |
| 3,958,206 | A * | 5/1976 | Klint | H01H 39/00 337/160 |
| 5,084,691 | A | 1/1992 | Lester et al. | |
| 5,097,247 | A | 3/1992 | Doerrwaechter | |
| 5,406,438 | A * | 4/1995 | Ranjan | H02H 3/021 361/103 |
| 5,712,610 | A | 1/1998 | Takeichi et al. | |
| 5,844,759 | A * | 12/1998 | Hirsh | H02H 11/005 361/103 |
| 5,990,572 | A * | 11/1999 | Yasukuni | H01H 39/006 180/271 |
| 6,141,202 | A * | 10/2000 | Maeckel | H01H 85/46 337/143 |
| 6,351,361 | B1 | 2/2002 | Kawazu et al. | |

(Continued)

FOREIGN PATENT DOCUMENTS

JP 2790433 B2 8/1998

*Primary Examiner* — Jayprakash N Gandhi
*Assistant Examiner* — Jacob Crum

(57) ABSTRACT

A fuse includes first, second, and third terminals disposed on a substrate. Respective ends of one or more primary conductors of the fuse are connected to one of the first and the second terminals. The primary conductors have a first conductivity and are configured to open when a primary current between the first and the second terminals exceeds a first predetermined threshold. One or more secondary conductors have an end connected to the third terminal. The secondary conductors are configured to ignite when a secondary current through the secondary conductors exceeds a second predetermined threshold. When ignited, the secondary conductors open the primary conductors to thereby stop the primary current.

12 Claims, 5 Drawing Sheets

(56) References Cited

U.S. PATENT DOCUMENTS

| | | | | |
|---|---|---|---|---|
| 6,566,995 | B2 | 5/2003 | Furuuchi et al. | |
| 2010/0073120 | A1* | 3/2010 | Knab ..... | H01H 37/761<br>337/416 |

* cited by examiner

REMOTE ACTIVATED FUSE AND CIRCUIT

BACKGROUND OF THE INVENTION

Field of the Invention

This application relates generally to electronic protection circuitry. More, specifically, the application relates to a remote activated fuse and circuit for using the remote activated fuse.

Introduction to the Invention

Protection circuits are utilized in electronic circuits to isolate failed circuits from other circuits. For example, a protection circuit may be utilized to prevent a cascade failure of circuit modules in an electronic automotive engine controller. Protection circuits may also be utilized to guard against more serious problems, such as a fire caused by a power supply circuit failure.

One type of protection circuit is an ordinary glass fuse. The glass fuse includes a conductor that behaves like a short circuit during normal operation. When the current through the conductor exceeds a threshold, the conductor opens and current flow stops.

Another protection circuit is a thermal fuse that transitions between short circuit and open circuit modes of operation when the temperature of the thermal fuse exceeds a specified temperature. To facilitate these modes, thermal fuses include a conduction element, such as a fusible wire, a set of metal contacts, or a set of soldered metal contacts, that can switch from a conductive to a non-conductive state. A sensing element may also be incorporated. The physical state of the sensing element changes with respect to the temperature of the sensing element. For example, the sensing element may correspond to a low melting metal alloy or a discrete melting organic compound that melts at an activation temperature. When the sensing element changes state, the conduction element switches from the conductive to the non-conductive state by physically interrupting an electrical conduction path.

One disadvantage with existing fuses is they are only configured to activate (i.e., open) during a single fault condition, such as either when the current exceeds a threshold or when a temperature exceeds a threshold.

BRIEF SUMMARY OF THE INVENTION

In a first aspect, a fuse includes first, second, and third terminals disposed on a substrate. Respective ends of one or more primary conductors of the fuse are connected to one of the first and the second terminals. The primary conductors have a first conductivity and are configured to open when a primary current between the first and second terminals exceeds a first pre-determined threshold. One or more secondary conductors of the fuse have respective first ends connected to the third terminal. The secondary conductors are configured to ignite when a secondary current through the secondary conductors exceeds a second pre-determined threshold. When ignited the secondary conductors open the primary conductors to thereby stop the primary current.

In a second aspect, a fuse-protected circuit includes a fuse housing and a component. The fuse housing includes first, second, and third terminals that are disposed on an outside surface of the housing. The first and second terminals are in series with a circuit to be protected. The fuse housing also includes a substrate. At least a portion of each of the first, second, and third terminals is also disposed on the substrate. Respective ends of one or more primary conductors are connected to one of the first and the second terminals. The primary conductors have a first conductivity and are configured to open when a primary current between the first and the second terminals exceeds a first predetermined threshold. The fuse housing also includes one or more secondary conductors with respective first ends connected to the third terminal. The secondary conductors are configured to ignite when a secondary current through the secondary conductors exceeds a second predetermined threshold. Ignition of the secondary conductors opens the primary conductors to thereby stop the primary current. The component includes a first end that is in electrical communication with the third terminal and a second end at a voltage potential that is different than the first terminal. The component facilitates current flow between the first terminal and the third terminal upon activation of the component, to thereby cause the secondary conductors to ignite and the primary conductors to open.

In a third aspect, a fuse includes a housing. First, second, and third terminals are disposed on an outside surface of the housing. The first and second terminals are in series with a circuit to be protected. A substrate is disposed within an interior of the housing. At least a portion of each of the first, second, and third terminals is also disposed on the substrate. One or more primary conductors and one or more secondary conductors are disposed within the housing. Respective ends of the primary conductors are connected to one of the first and the second terminals. The primary conductors have a first conductivity and are configured to open when a primary current between the first and the second terminals exceeds a first predetermined threshold. Respective first ends of the secondary conductors are connected to an electrode. The secondary conductors are configured to ignite when a secondary current through the secondary conductors exceeds a second predetermined threshold. Ignition of the secondary conductors opens the primary conductors to thereby stop the primary current. A component is also disposed with the housing. The component includes a first end that is in electrical communication with the third terminal disposed on the substrate and a second end in electrical communication with the electrode. The component facilitates current flow between the electrode and the third terminal upon activation of the component, to thereby cause the secondary conductors to ignite and the primary conductors to open.

BRIEF DESCRIPTION OF THE DRAWINGS

The accompanying drawings are included to provide a further understanding of the claims, are incorporated in, and constitute a part of this specification. The detailed description and illustrated embodiments described serve to explain the principles defined by the claims.

DETAILED DESCRIPTION OF THE INVENTION

The embodiments described below describe fuses that are configured to open when a primary current that flows between first and second terminals of the device exceeds a threshold. The fuses are further configured to be remotely activated (i.e., opened) by allowing current flow through a third terminal of the fuse.

Figure 1:
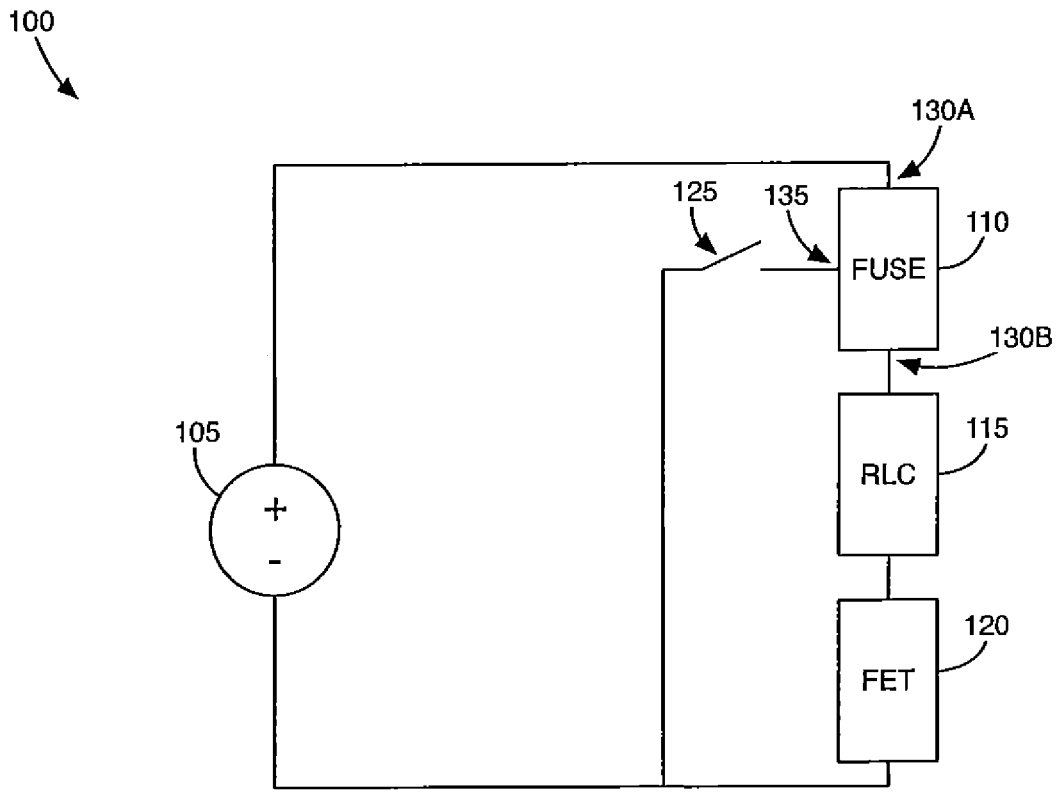
FIG. 1 is a schematic of a first exemplary circuit that may be utilized in connection with a first remote activated fuse embodiment.

FIG. 1 is a schematic of an exemplary fuse-protected circuit 100. The exemplary circuit 100 includes a power source 105, a first fuse embodiment 110, an exemplary RLC circuit 115, and a FET device 120. The fuse 110 includes a housing with first, second, and third terminals (130A, 130B, 135) that are disposed on the outside of the housing. The first, second, and third terminals (130A, 130B, 135) are in electrical contact or communication with circuitry positioned within the housing. The circuitry is described in detail below.

The fuse 110 is connected in series with the RLC circuit 115 and the FET 120. The first terminal 130A of the fuse 110 is connected to a first side of the power source 105. The second terminal 130B of the fuse 110 is connected into the RLC circuit 115. During normal operation, (i.e., non-fault condition), current flows between the first terminal 130A and the second terminal 130B of the fuse 110. During a fault condition, the fuse 110 opens, thus preventing current flow through the RLC circuit 115 and the FET 120. A fault may occur when, for example the FET 120 shorts. In this case, the current through the fuse 110 will exceed a threshold. This in turn, will cause a primary conductor 305 (FIG. 3) within the fuse 110 to open.

The third terminal 135 of the fuse facilitates remote activation of the fuse 100. In one implementation, when the third terminal 135 is connected to a potential different from the potential at the first and second terminals (130A and 130B), current will flow through the third terminal 135 and will cause the fuse 110 to open. That is, the fuse 110 can be made to open even though the primary current is below the threshold current necessary to cause the primary conductor 305 to open.

In one implementation, the third terminal 135 is coupled to a component 125 that exhibits opened and closed conduction states. When the component 125 is activated, the third terminal 135 is brought to a potential that is different than the potential at the first and second terminals (130A, 130B). For example, the component 125 may be a passive device such as a pressure, temperature, humidity, etc. sensing switch. The component 125 may be an active device such as a transistor switch configured to change conduction state base on a sensed voltage. The component 125 may correspond to a bimetal strip, or a different device that changes conduction states based on a temperature. The component 125 may be external to the fuse 110, though in some implementations the component 125 could be positioned within the housing of the fuse 110.

Figure 2:
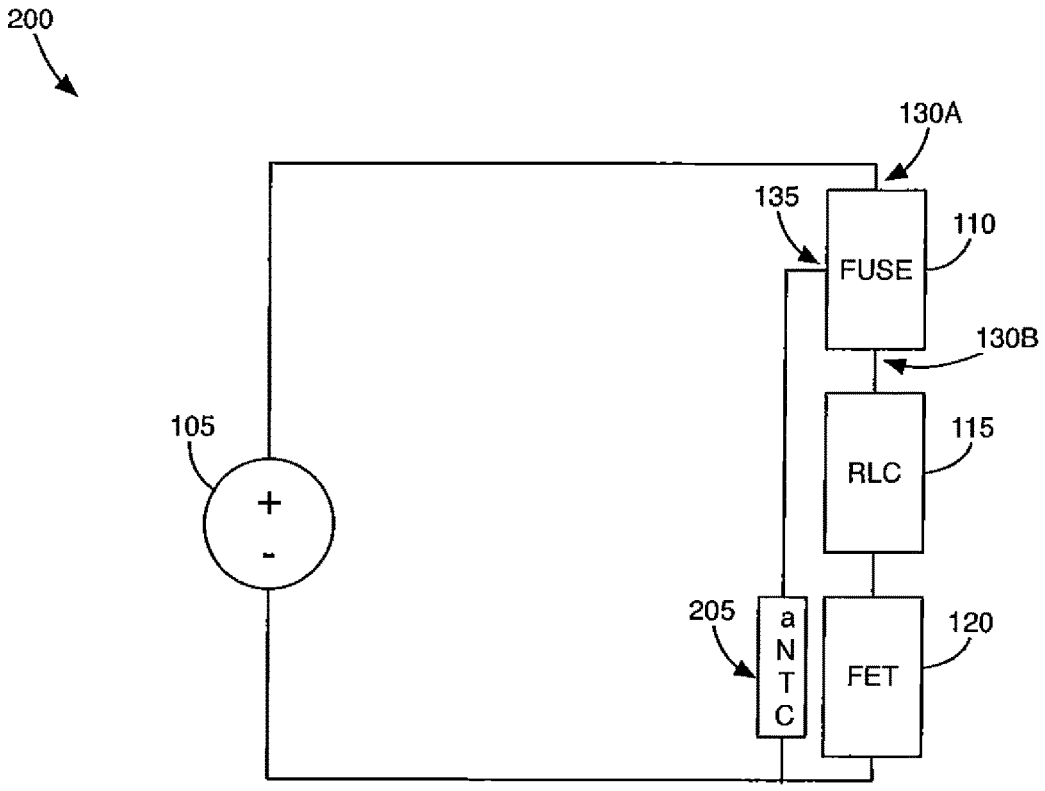
FIG. 2 is a schematic of a second exemplary circuit that may be utilized in connection with the first remote activated fuse embodiment.

In one implementation, the component is an anomalous negative-temperature-coefficient (aNTC) device 205 (FIG. 2) such as vanadium dioxide incorporating doping compounds. Referring to FIG. 2, the aNTC device 205 comprises a material with a resistance that varies with temperature. The aNTC device 205 may be characterized as having a high resistance below a threshold temperature and a low resistance above the threshold temperature. The aNTC device 205 may be placed adjacent to a critical component, such as a FET 120 so as to trigger the fuse 110 when the temperature of the FET 120 exceeds a threshold temperature. This facilitates opening of the fuse 110 potentially before damage occurs to the circuit 200 as a result of an imminent failure of the FET 120. It should be emphasized that the circuits of FIGS. 1, 2, and 5 (described below) are only shown for illustrative purposes and that the fuse embodiments illustrated in the figures can be configured to protect different circuit configurations.

Figure 3:
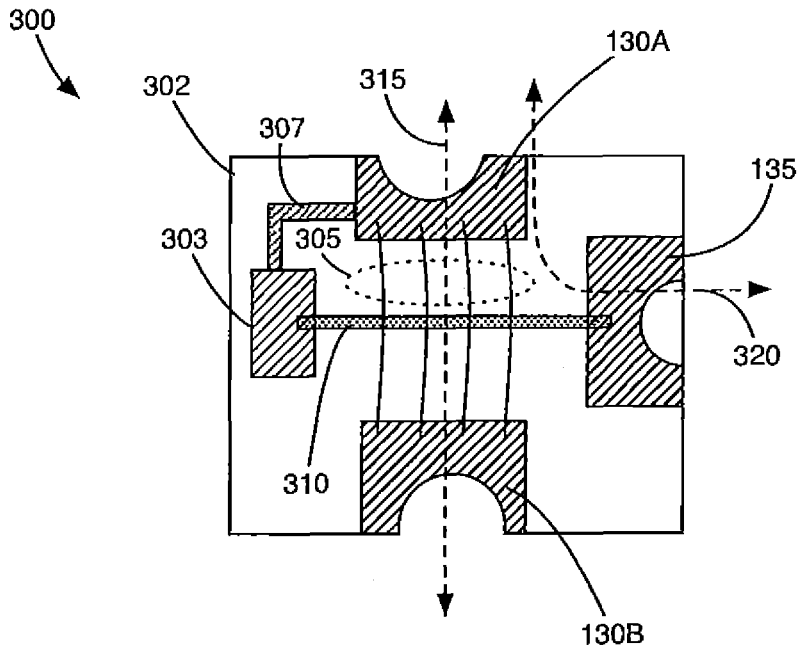
FIG. 3 illustrates an interior representation of the first remote activated fuse embodiment.

FIG. 3 illustrates an interior view of a first fuse embodiment 300 that may correspond to the fuse 110 illustrated in FIG. 1. The fuse 300 includes a substrate 302, first, second, and third terminals (130A, 130B, and 135), primary conductors 305, and a secondary conductor 310. The terminals (130A, 130B, and 135) are disposed on the substrate 302 and may be plated to facilitate soldering of the fuse 300 to a circuit board.

On implementation, respective ends of the primary conductors 305 are connected to the first and second terminals (130A, 130B). The primary conductors 305 may comprise copper, tin, zinc, or a combination thereof, or a different conductive material having a first conductivity. For example, the primary conductors may correspond to copper wires. The primary conductors 305 are sized and/or numbered to open when a primary current 315 between the first and second terminals (130A, 130B) exceeds a first pre-determined threshold. The threshold at which the primary conductors 305 open may be adjusted by changing the dimensions of the primary conductors 305 and/or the number of primary conductors 305. The threshold may also be changed by varying the composition of the primary conductors 305.

The secondary conductor 310 has a first end connected to an electrode 303 that is disposed on the substrate 302 and a second end connected to the third terminal 135. The secondary conductor 310 is positioned across the primary conductors 305. For example, the secondary conductor 310 may be arranged perpendicularly with respect to the primary conductors 305. The secondary conductor 310 is configured to ignite (i.e., cause an exothermic reaction) when a secondary current 320 through the secondary conductor 310 exceeds a second predetermined threshold current. The second predetermined threshold current at which the secondary conductor 310 ignites may be the same as or different from the primary conductor current 315 at which the primary conductors 305 open. For example, the secondary conductor 310 may comprise an exothermic reactive material such as a palladium/aluminum (Pd/Al) wire, which ignites when the current flow though the material exceeds a threshold and continues to burn until the reactive materials are exhausted. Ignition of the secondary conductor 310 causes the primary conductors 305 to melt and thereby open.

In some implementations, in the region where the secondary conductor 310 crosses the primary conductors 305, the secondary conductor 310 is raised above the substrate 302 to allow the secondary conductor 310 to heat more rapidly than would occur if the secondary conductor 310 were to be in contact with the substrate 302. For example, an insulating air gap or an insulating material may be provided between the secondary conductor 310 and the substrate 302. In this regard, a higher current may be required to ignite the secondary conductor 310 if it were in contact with the substrate 302.

To further facilitate opening of the primary conductors 305, the secondary conductor 310 may be in direct contact with the primary conductors 305. For example, in one implementation, the primary conductors 305 may form the shape of an arc as they extend between the first and the second terminals (130A, 130B). The secondary conductor 310 may be configured to contact the primary conductors 305 at their apex, which may be centered between first and second terminals (130A, 130B).

In another implementation, the primary conductors 305 may be interwoven within the secondary conductor. For example, even numbered primary conductors 305 may be positioned below the secondary conductor 310 and odd numbered primary conductors 305 may be positioned above the secondary conductor 310.

In yet another implementation, instead of a single continuous conductor, each primary conductor 305 is split in a middle region and comprises a first section and a second section. The first section couples the first terminal 130A to the secondary conductor 310. The second section couples the second terminal 130B to the secondary conductor 310. This configuration forces primary current flow 315 to flow through a portion of the secondary conductor 310, thus guaranteeing interruption in the primary current path when the secondary conductor 310 is ignited.

Figure 4:
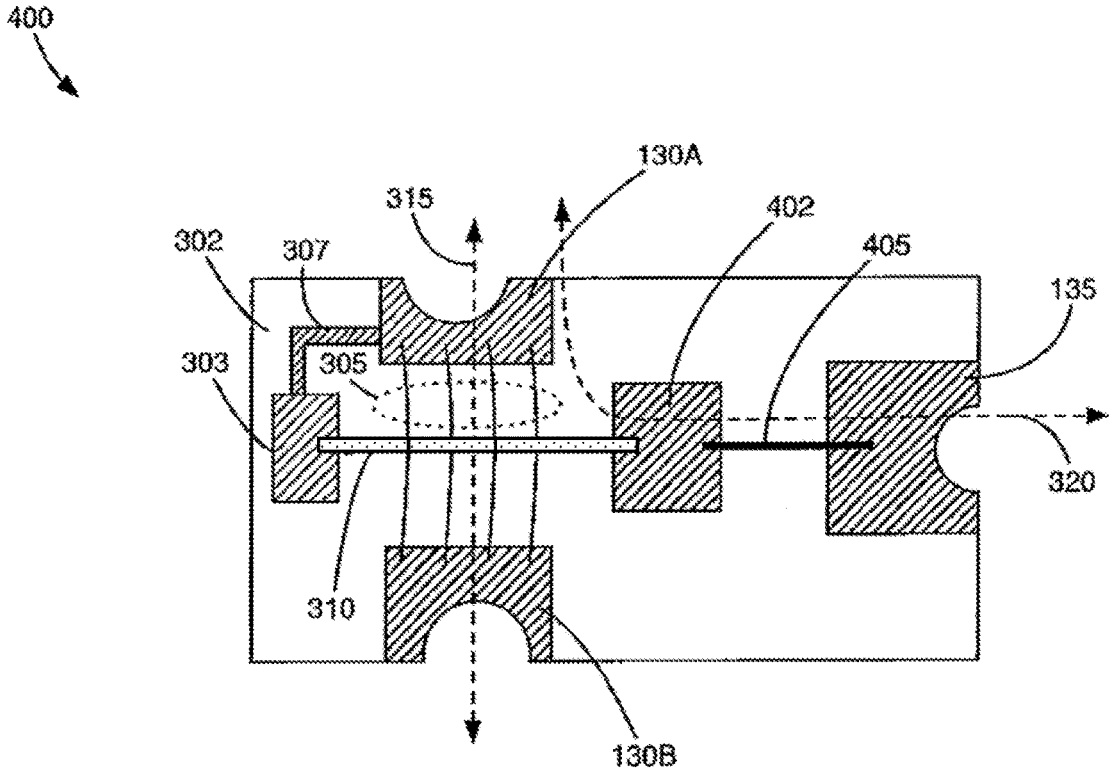
FIG. 4 illustrates an interior representation of a second remote activated fuse embodiment.

In another implementation, the primary conductors 305 may be interwoven within the secondary conductor (see the embodiment shown in FIG. 4, for example). For example, even numbered primary conductors 305 may be positioned below the secondary conductor 310 and odd numbered primary conductors 305 may be positioned above the secondary conductor 310.

In other implementations, the secondary conductor 310 is connected to the third terminal 135 and a fourth terminal (not shown). A potential may be provided across the third terminal 135 and the fourth terminal to cause the secondary conductor 310 to ignite and thereby open the primary conductors 305.

FIG. 4 illustrates an interior view of a second fuse 400 embodiment. The fuse 400 includes a substrate 302, first, second, and third terminals (130A, 130B, and 135), primary conductors 305, and a secondary conductor 310. The respective members are generally arranged as described above and possess the features described above with respect to the first fuse embodiment 300.

However, in the second fuse 400 embodiment, the secondary conductor 310 extends between the first electrode 303 and the second electrode 402. A first end of a resilient conductive member 405 is connected to the third terminal 135. A second end of the resilient conductive member 405 is configured to contact the second electrode 402 when the resilient conductive member 405 is above a threshold temperature. Below the threshold temperature, the second end of the resilient conductive member 405 is spaced apart from the second electrode 402. When in contact, a path for the secondary current 320 to flow to the third electrode is provided. It is understood that the resilient conductive member 405 could also be connected to the second electrode 402 and configured to contact the third terminal 135 when the temperature of the resilient conductive member 405 exceeds the temperature threshold. In some implementations, the resilient conductive member 405 is a bimetal strip that changes shape with a temperature change.

In alternate implementations, the resilient conductive member 405 may be replaced with a component 125 that exhibits open and closed conduction states. When the component is activated, the second electrode 402 is brought to the potential present at the third terminal 135. The component 125 may be a passive device such as a pressure, temperature, humidity, etc. sensing switch. The component 125 may be an active device such as a transistor switch configured to change conduction state base on a sensed voltage. The component 125 may correspond to a bimetal strip, or a different device that changes conduction states based on temperature.

Figure 5:
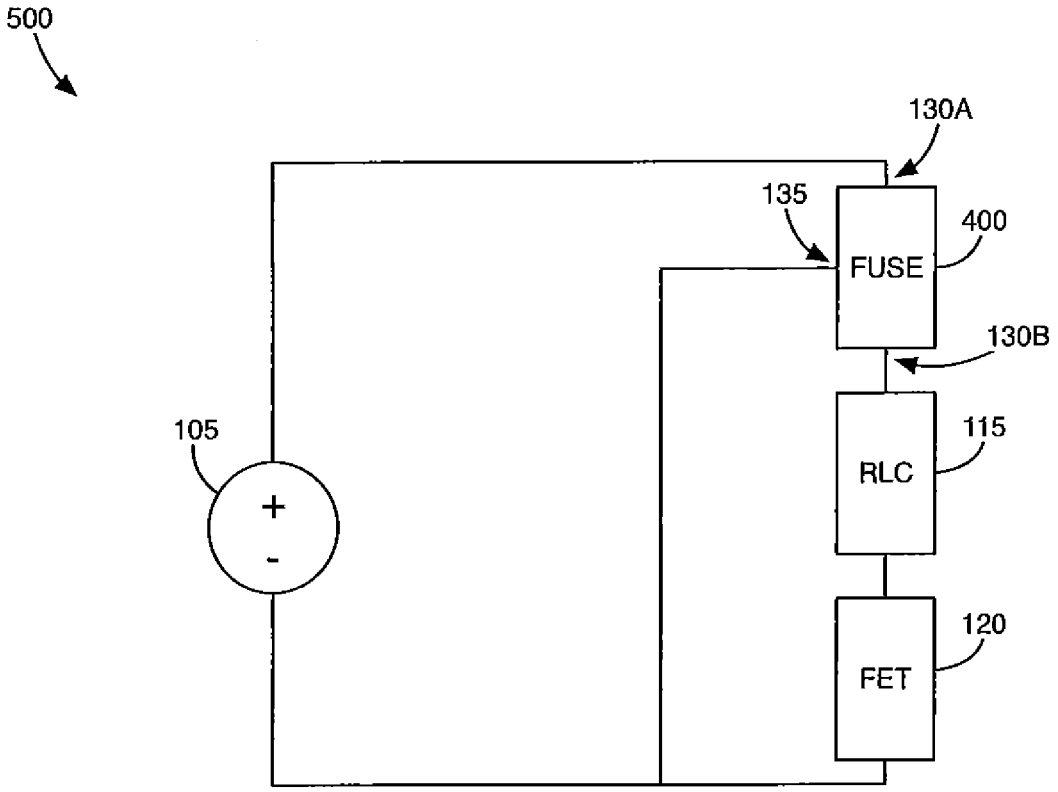
FIG. 5 is a schematic of an exemplary circuit that may be utilized in connection with the second remote activated fuse embodiment.

FIG. 5 is a schematic of an exemplary fuse-protected circuit 500 that utilizes the second fuse embodiments 400. The exemplary circuit 500 also includes a power source 105, an exemplary RLC circuit 115, and a FET device 120. The various components are generally arranged as described above. However, in this case, the third electrode 135 may be directly connected to a node with a potential different than the potential at the first and second electrodes (130A, 130B). That is, an external switch or NTC device is not required. To facilitate an alternate means of activating the fuse 400, the fuse 400 may be placed adjacent to or in contact with a critical component such as the FET device 120. Excessive heat generated by such a component causes the resilient conductive member of the fuse 400 to close and thereby ignite the secondary conductors within the fuse 400. This in turn causes the primary conductors to open.

While various embodiments have been described, it will be apparent to those of ordinary skill in the art that many more embodiments and implementations are possible that are within the scope of the claims. For example, while various elements are described as being coupled or connected to one another, the term does not necessarily imply direct coupling or connection in that various intermediary elements may be added between the elements of the embodiments without significantly changing the behavior of the elements. Any such modifications are understood to fall within the scope of protection afforded by the claims. Accordingly, it will be apparent to those of ordinary skill in the art that many more embodiments and implementations are possible that are within the scope of the claims. Therefore, the embodiments described are only provided to aid in understanding the claims and do not limit the scope of the claims.

What is claimed is:

1. A fuse comprising:

first, second, and third terminals disposed on a substrate;

one or more primary conductors with respective ends connected to one of the first and the second terminals, wherein each of the one or more primary conductors has a first conductivity and opens when a primary current between the first and the second terminals exceeds a first pre-determined threshold; and one or more secondary conductors in direct contact with, and interwoven with, the one or more primary conductors with first ends connected to the third terminal, at least one of the one or more secondary conductors to ignite via a secondary current flowing through the at least one of the one or more secondary conductors that exceeds a second predetermined threshold, wherein ignition of the at least one of the one or more secondary conductor opens the one or more primary conductors to thereby stop the primary current.

2. The fuse according to claim 1, wherein the secondary current flows between the first terminal and third terminal.

3. The fuse according to claim 1, wherein at least a portion of the one or more secondary conductors is separated from the substrate by an insulator.

4. The fuse according to claim 1, further comprising an electrode and a bridge connector, wherein second ends of the one or more secondary conductors are connected to the electrode, and wherein at least one of the first terminal and the second terminal are connected to the bridge connector.

5. The fuse according to claim 1, wherein the one or more secondary conductors comprises exothermic reactive material.

6. A fuse protected circuit comprising:

a fuse housing that comprises:

first, second, and third terminals disposed on an outside surface of the housing, wherein the first and second terminals are in series with a circuit to be protected;

a substrate, wherein at least a portion of each of the first, second, and third terminals is also disposed on the substrate;

one or more primary conductors with respective ends connected to one of the first and the second terminals, wherein the one or more primary conductors has a first conductivity and opens when a primary current between the first and the second terminals exceeds a first predetermined threshold; and one or more secondary conductors in direct contact with, and interwoven with, the one or more primary conductors with respective first ends connected to the third terminal, at least one of the one or more secondary conductors to ignite via a secondary current flowing through at least one of the one or more secondary conductors that exceeds a second predetermined threshold, wherein ignition of the at least one of the one or more secondary conductors opens the primary conductors to thereby stop the primary current; and a component with a first end in electrical communication with the third terminal and a second end at a voltage potential that is different than the first terminal, wherein the component facilitates current flow between the first terminal and the third terminal upon activation of the component, to thereby cause the secondary conductors to ignite and the primary conductors to open.

7. The fuse protected circuit according to claim 6, wherein the component corresponds to an anomalous negative-temperature-coefficient device or a linear NTC device with a resistance that decreases as a temperature of the NTC device increases.

8. The fuse according to claim 6, wherein the secondary current flows between the first terminal and third terminal.

9. The fuse according to claim 6, further comprising an electrode and a bridge connector, wherein a respective second end of the one or more secondary conductors is connected to the electrode, and wherein at least one of the first terminal and the second terminal are connected to the bridge connector.

10. The fuse according to claim 6, wherein the one or more secondary conductors comprise exothermic reactive material.

11. The fuse according to claim 1, the one or more secondary conductors to ignite via an exothermic reaction that exhausts at least a portion of the one or more secondary conductors.

12. The fuse according to claim 6, the one or more secondary conductors to ignite via an exothermic reaction that exhausts at least a portion of the one or more secondary conductors.

* * * * *